US005667416A

United States Patent [19]

Barth

[11] Patent Number: 5,667,416

[45] Date of Patent: Sep. 16, 1997

[54] FLOTATION DEVICE AND SWIMMING AID

[76] Inventor: Terry D. Barth, 6720 East Bay Blvd., Navarre, Fla. 32566

[21] Appl. No.: 594,730

[22] Filed: Jan. 31, 1996

[51] Int. Cl.[6] ..... B63C 9/08

[52] U.S. Cl. ..... 441/130; 441/131

[58] Field of Search ..... 441/35, 43, 55, 441/125, 126, 129, 130, 131, 132, 133, 136

[56] References Cited

U.S. PATENT DOCUMENTS

| | | | |
|---|---|---|---|
| 1,748,170 | 2/1930 | Chestnut | 441/131 |
| 2,051,281 | 8/1936 | Webber | 441/131 |
| 2,562,080 | 7/1951 | Barnes | 441/131 |
| 2,946,068 | 7/1960 | Jasper | 441/130 |
| 3,161,897 | 12/1964 | Hill | 441/130 |
| 3,656,749 | 4/1972 | Reyes | 441/133 |

FOREIGN PATENT DOCUMENTS

| | | | |
|---|---|---|---|
| 2108435 | 5/1983 | United Kingdom | 441/130 |

*Primary Examiner*—Stephen Avila

*Attorney, Agent, or Firm*—George A. Bode; Michael L. Hoelter

[57] ABSTRACT

A floatation device for safely supporting a person, including paralyzed, disabled, or mobility impaired persons, upon a body of water for exercise or relaxation. This device encloses the person within concentric outer flotation members and a seat assembly from which position the person may float, walk or wade in the water as desired while either being continuously supported or providing only the support required. The outer flotation members are spaced from the user to also enclose him and these outer members provide the buoyancy and stability required for use. If desired, a hand rest can be positioned intermediate the outer flotation members and seat assembly of the floatation device for further ease of use and for grasping purposes.

10 Claims, 3 Drawing Sheets

FLOTATION DEVICE AND SWIMMING AID

BACKGROUND OF THE INVENTION

1. Field of the Invention

This invention pertains to flotation devices and swimming aids in general and, more particularly, to a device that allows handicapped or disabled individuals to independently float or become immersed in a body of water for exercise or relaxation.

2. General Background

Many different kinds of flotation devices and swimming and diving aids currently exist or are known. Some of them, such as U.S. Pat. No. 4,815,761 issued to Henderson, et al., are primarily designed to carry water equipment over land but which can also float, thereby allowing the swimmer to rest upon the device in the water if so desired.

Others, such as U.S. Pat. No. 5,186,667 issued to Wang, are more like inflatable water mattresses which fully support the user in the horizontal position from head to foot. Because this type of flotation device or swimming aid generally encloses and supports the entire body of the user above or separate from the water, the user is not then able to also immerse himself in the water for exercise purposes. This is more of a passive type of device in that it provides a great deal of buoyancy so as to enable the user to horizontally float on top of the water.

Another version of the water mattress type of swimming aid is shown in U.S. Pat. No. 4,861,300 issued to Casagrande, et al. In this version, the user is not fully supported above and separate from the water, but instead is partially immersed in the water in the horizontal position on his back. The user can flex the device so as to sit upon it, but no front or back support is provided, thereby requiring the user to delicately maintain his balance when in this position. Because of the position of the user when employing this device, movement of the user's arms and legs is limited.

U.S. Pat. No. 1,567,555 issued to Straussler and U.S. Pat. No. 1,671,874 issued to Rawlings both disclose a vessel that is more like a boat than a raft. In the former, the vessel is moved either under wind power or via a paddle while in the latter, the vessel is moved via a propeller which the user operates. In both cases, the user is generally limited to only one position in the vessel (i.e. sitting) which limits the ability of the user to exercise both his arms and legs. Also, in the former, the only support provided is by sitting upon the seat while in the latter, the vertically stacked inflatable side walls may allow the user to "lean back" while pedaling, but these side walls also severely restrict the mobility of the user.

U.S. Pat. No. 2,946,068 issued to Jasper discloses a float into which a baby or small child is placed in a sitting position. The seat is such that the user can either keep his knees flexed or straight, but no kicking (such as in a swimming stroke) is permitted. Also, since the user is literally restrained in an upright sitting position, all the user can do is dangle his hands and arms in the water, again, no swimming stroke is allowed due to the position of the user in the device. Thus, this device passively restrains the user in place without allowing him to exercise or easily move the device around on the water.

It is thus an object of this invention to provide a buoyant vessel that not only supports a user above the water, but also allows him to fully exercise his arms and legs at the same time.

Another object of this invention is to provide a vessel that is capable of safely supporting a disabled or handicapped person while also allowing this person to swim and kick in order to steer and guide the vessel. This invention can also be used by those whose mobility is restricted or has been compromised for any number of reasons, including age or illness.

A further object of this invention is to provide a vessel that is simple to construct and easy to maintain and transport.

Yet another object of this invention is to provide a vessel that provides rigid support to suspend the user within the water, but also provides the user considerable freedom of movement so that every part of the user's body can be exercised if so desired.

Still another object of this invention is to allow the user to walk along the bottom of the water, provided the water is at the proper depth, while providing stability should the user falter. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is disclosed is a flotation device that is designed to safely support a person, including those that may be paralyzed or handicapped, upon a body of water. This floatation device consists of outer buoyancy members that form a continuous enclosure around and spaced from the user. A plurality of elongated braces, each having one end secured to these outer buoyancy members, extend inwardly therefrom toward the user. A seat assembly that is secured to the opposite ends of these inwardly extending braces for supporting the user therein. This seat assembly is configured as a closed loop from which a seat made of a flexible fabric or the like is suspended. A hand rest is spaced from this closed loop seat assembly and is secured within the outer buoyancy members to at least one of the outer buoyancy members.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
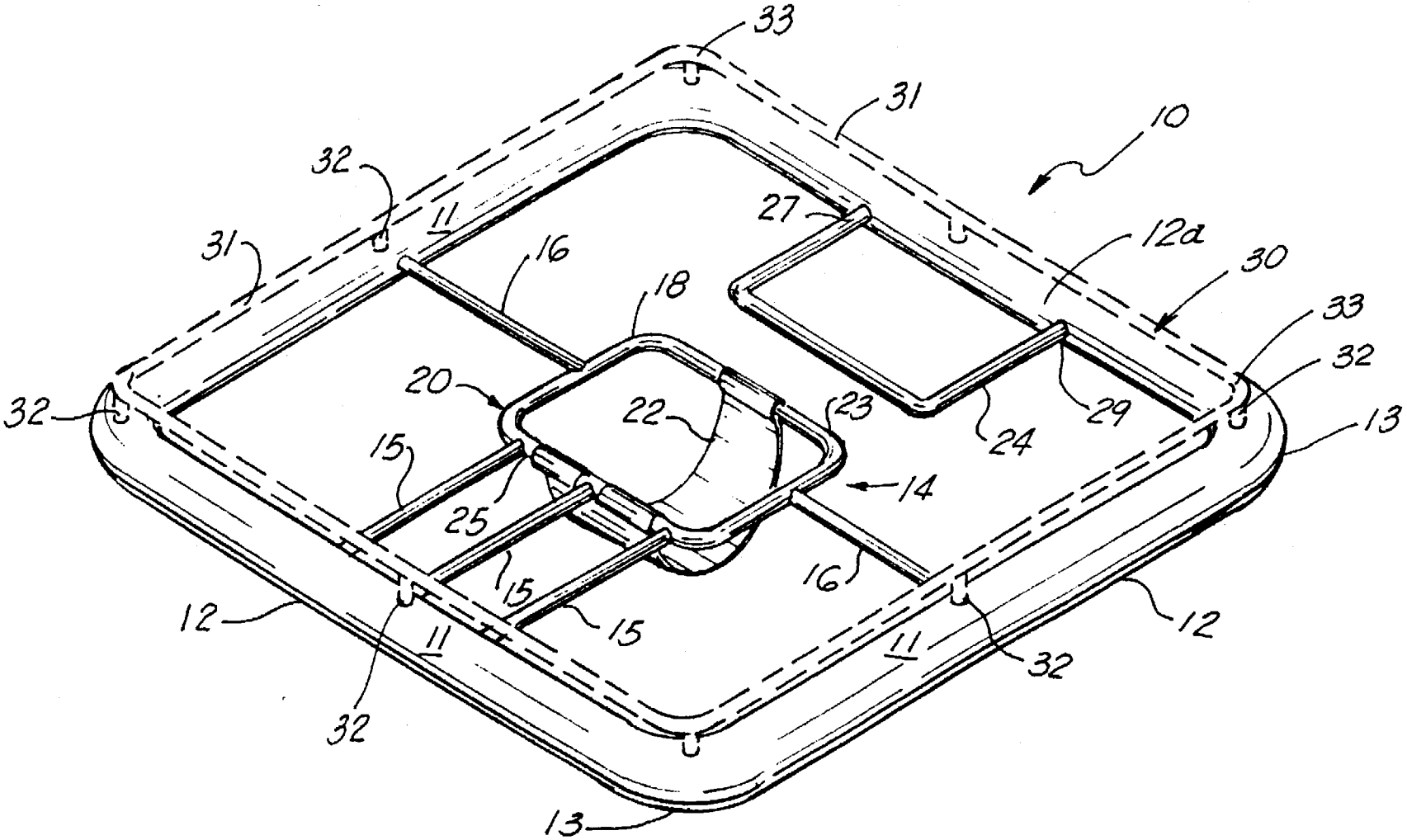
FIG. 1 is a perspective view of the preferred embodiment of the apparatus of the present invention taken from the top, rear and right side thereof.

Referring initially to the drawing (FIGS. 1–6), there is shown flotation vessel or swimming aid or walker 10. This walker 10 is preferably configured in a square or rectangular shape, best illustrated in FIGS. 1, 2 and 5, but it can also be round or circular, or any other shape, if so desired. Walker 10 basically consists of outer support members 12 and inner support means 14 which are integrally secured together by braces or supports 16 for strength and rigidity. Inner support means 14 is designed so as to be unobtrusive to the user, thereby providing him with maximum open area for freedom of movement of his arms and legs while also safely supporting him well above the water's surface.

Figure 2:
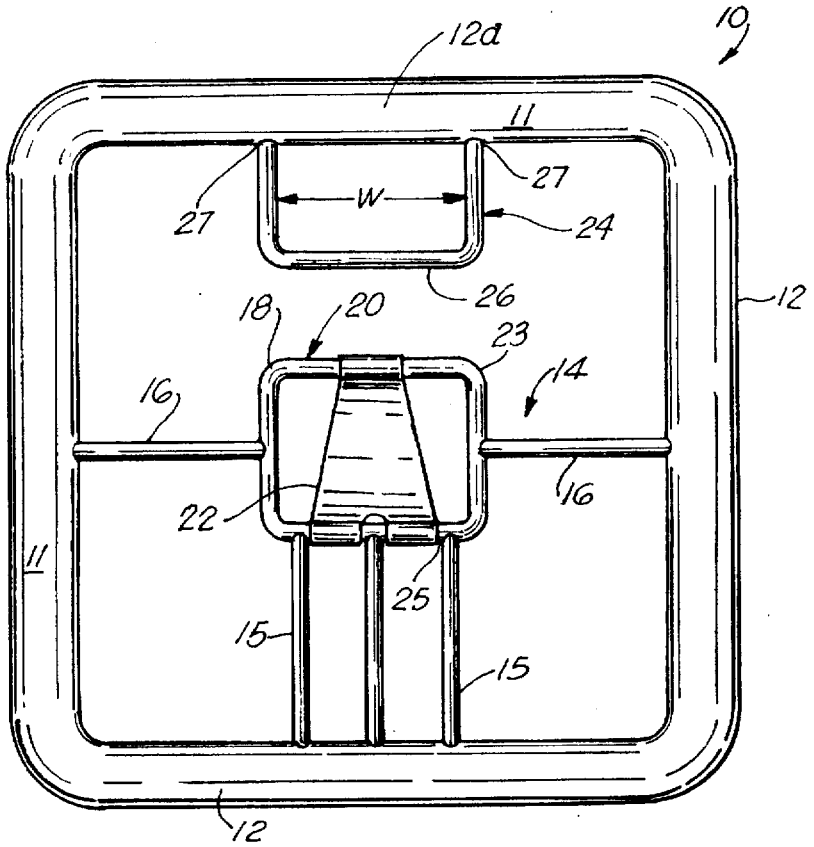
FIG. 2 is a top plan view of the embodiment of FIG. 1.
Figure 3:
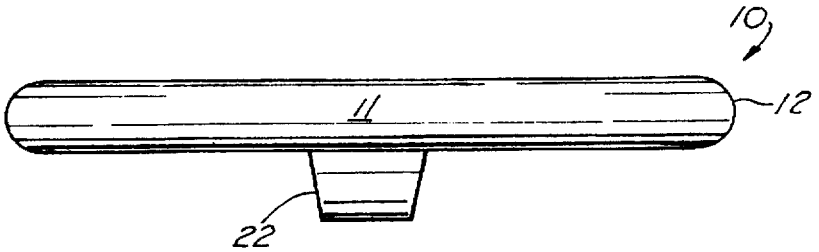
FIG. 3 is a rear elevational view of the embodiment of FIG. 1.
Figure 4:
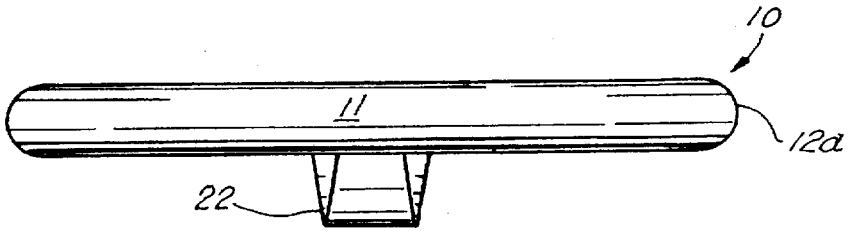
FIG. 4 is a front elevational view of the embodiment of FIG. 1.
Figure 5:
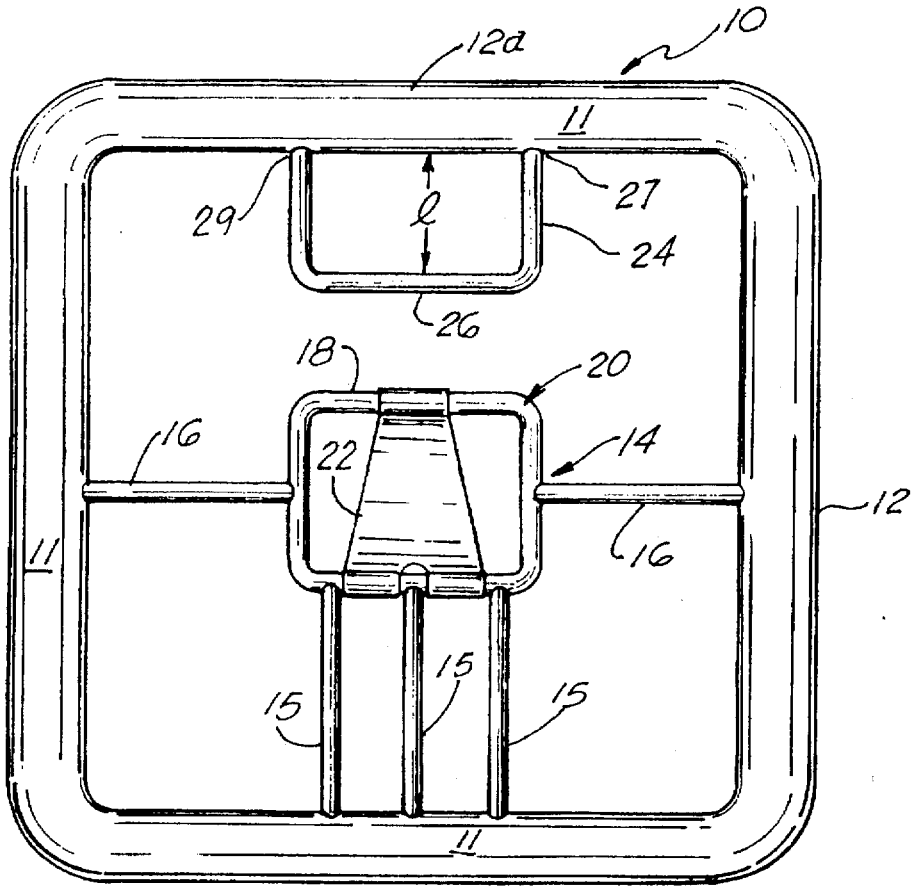
FIG. 5 is bottom plan view of the embodiment of FIG. 1.

Outer support members 12 provide buoyancy to walker 10. These members 12 can consist of hollow tubing, such as plastic piping, or they can consist of foam covered supports (the supports being either solid or hollow with the foam providing the necessary buoyancy). Regardless of the construction of such members 12, it is preferable for them to be wrapped or enclosed within a soft outer padding 11 so as to protect the user (as well as others) from injury. This outer padding will also protect the integrity of the foam covered supports if such is the construction of walker 10 (in which case this soft outer padding may simply be a durable fabric). Such a soft outer padding is desired so that outer members 12 may be hit or kicked without harming the user. Also, it is preferable for such buoyancy or outer members 12 to be constructed of a non-rusting, durable material so that the fear of breaking due to corrosion is eliminated, especially since such soft outer padding (or foam) may inadvertently trap moisture next to such members 12 while walker 10 is being stored. As shown in FIGS. 1, 2 and 5, outer support or buoyancy members 12 are interconnected to each other (or integral) to form the continuous enclosure of walker 10.

One embodiment of walker 10 employs lengths of plastic piping (such as PVC piping) that is only a few inches in diameter (in the range of about 2 to 6 inches). This size piping, when closed or sealed, provides the buoyancy desired. The four corners 13 of walker 10 then simply consist of four 90° elbows which connect the lengths of piping together. For additional comfort and safety, all of this piping and these fittings would preferably be wrapped in soft outer padding 11. In this manner, walker 10 may be easily assembled and disassembled as needed, especially if soft outer padding 11 consists of a slit foam tube that simple presses over such piping and fittings.

Interior of buoyancy members 12, and connected thereto, is positioned support means 14. This support means 14 consists of a series of longitudinal and transverse braces or supports 15, 16, respectively, which support seat assembly 18. These braces or supports 15, 16 are generally constructed of the same material as buoyancy members 12, but of a much smaller diameter or cross-section. For example, should walker 10 be constructed of PVC piping, then braces or supports 15, 16 can be constructed of the same material, but of about one (1") inch diameter or so. Such braces 15, 16 can be secured to buoyancy members 12 by reduced fittings and "T" connectors if so desired. Any connections between the braces 15, 16 themselves would be via normal sized fittings. However, if desired, braces 15, 16 and buoyancy members 12 may be bolted, glued, welded or otherwise secured together depending upon the material from which members 12 and braces 15, 16 are constructed. In any event, no matter how they are connected, braces 15, 16 provide rigidity to buoyancy members 12 while also centrally supporting seat assembly 18.

Seat assembly 18 is also generally constructed of the same material as braces 15, 16. In this embodiment, seat assembly 18 comprises a closed loop or enclosure 20 that is supported from opposing sides by a plurality of braces, transverse braces 16. The rear portion 25 of closed loop or enclosure 20 is also secured to buoyancy members 16 via a plurality of braces, longitudinal braces 15. However, the final configuration of the manner of support of seat assembly 18 may vary as needed. In any event, as indicated in the drawing, the user is generally surrounded by two separate concentric enclosures 12, 20 while positioned in walker 10. The first enclosure is defined by outer support or buoyancy members 12 while the second enclosure is defined by closed loop 20 of seat assembly 18.

Figure 6:
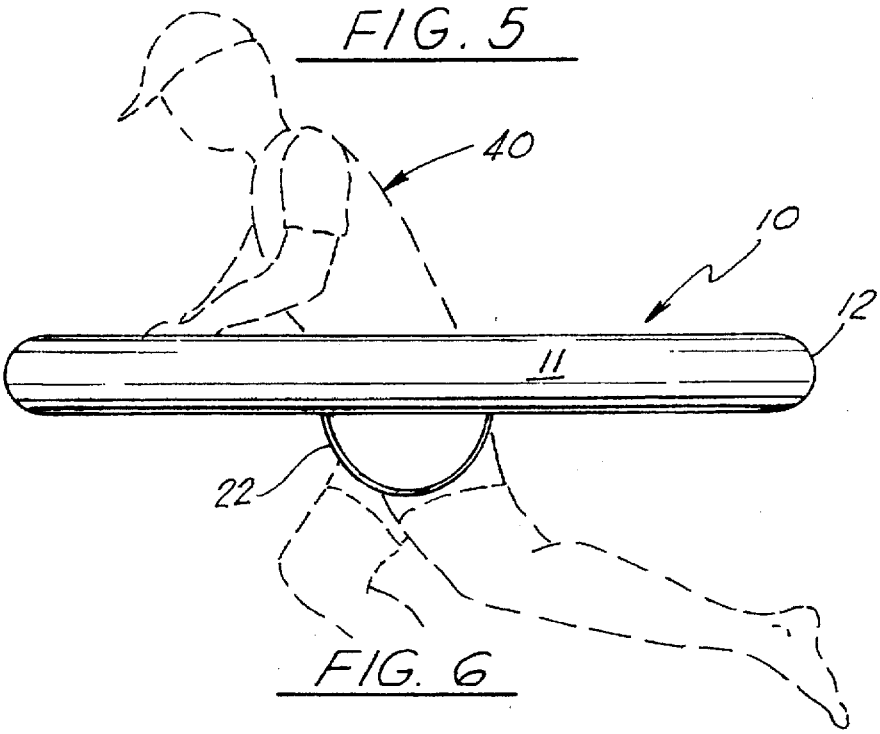
FIG. 6 is a left side elevational view of the embodiment of FIG. 1, the right side being a mirror image.

Suspended within closed loop 20 is seat 22. Generally seat 22 is slung from opposite portions or ends 23, 25 of closed loop 20 in the manner of a hammock, thereby providing two leg openings on either side of seat 22 between it and closed loop 20. Such openings are large enough to enable the legs of the user 40 (in PHANTOM) to freely move or kick as needed, as best illustrated in FIG. 6. Also, seat 22 is constructed of a soft pliable material, such as a nylon fabric, so that it may be easily crumpled between the user's legs without chafing or any discomfort while still providing the necessary strength when the user is in the sitting position. In this fashion, should the user 40 (in PHANTOM) desire to walk along the bottom of the water, as best illustrated in FIG. 6, seat 22 will not interfere with such leg movement, however, should the user decide instead to float upon the water, the user need only sit upon seat 22, in which case the back of closed loop 20 can act as a backrest.

To retain seat 22 in place without slippage to one side or the other of closed loop 20, seat 22 is fastened to closed loop 20 on opposite sides of transverse braces 16 and to at least one of brace 15, as best shown in FIGS. 1, 2 and 5. Thus, by this construction, these braces 15, 16 prevent seat 22 from sliding one way or the other, thereby keeping it centrally positioned within closed loop 20.

Immediately in front of seat assembly 18 is hand rest 24. Hand rest 24 is also constructed of the same material as braces 15, 16 and closed loop 20. This hand rest 24 is generally centrally located along the front buoyancy member 12*a* some distance from seat assembly 18, as best seen in FIGS. 1, 2 and 5, but without any connection between the two. Hand rest 24 is generally U-shaped with each of its open ends 27, 29 rigidly secured to this front buoyancy member 12*a* in the normal fashion thereby also forming a closed loop. Also, if desired, the size (length "l" and width "w", FIGS. 2 and 5) of the opening defined by hand rest 24 may be the same as closed loop 20 or such opening sizes may be different. Additionally, if desired, hand rest 24 may be centrally aligned with respect to seat assembly 18 for ease of use and grasping. By this configuration and as seen in FIGS. 1 and 2, large areas on opposite sides of hand rest 24 and closed loop 20 remain open and unobstructed, thereby enabling the user to swim or otherwise use his arms for play or exercise.

An alternate embodiment of the present invention is shown in PHANTOM in FIG. 1 and comprises the parallel mounting of railing 30 to the upper side of float members 12. Railing 30 comprises piping similar to braces 15, 16 and loop 20 and hand rest 24, thus being of smaller diameter then members 12. Railing 30 has portions 31 mounted on the upper side of and parallel to members 12 by means of vertical supports 32 spaced therearound. As with members 12, rail portions 31 can be connected by four (4) 90° elbows 33 or formed integrally into a rectangular shape as that of members 12 (or circular shape, etc.), as the case may be. Railing 30 can be secured to supports 32 which in turn can be secured to members 12 in the conventional way (welding, etc.) or be formed integrally therewith. Railing 30 gives the user an additional means of support during operation.

The use of walker 10 would involve placing the user 40 (in PHANTOM in FIG. 6) within seat assembly 18 while walker 10 is floating upon the water. If walking is desired, the user would simply stand upright within closed loop 20 while moving his legs since seat 22 would easily be crushed together between the user's legs. If continuous or temporary support is needed or if the user falters for any reason, the user need only grasp transverse braces 16 or transverse bar 26 of front hand rest 24 to again regain balance (as illustrated in FIG. 6). Also, if desired, the user could lean upon or grasp any side of closed loop 20 for further stability as needed.

On the other hand, if the user desires to float in a sitting position, he need only sit upon seat 22 (and use the back of closed loop 20 as a backrest) so that his legs no longer touch the bottom of the water. The large open areas on either side of seat assembly 18 and hand rest 24 permit the user to easily maneuver or steer walker 10 by moving his arms and hands in the water. Also, if desired, the user may kick with his legs underneath walker 10 to further move or steer walker 10.

Now, should the user desire to swim in a more horizontal position, he need only lean forward upon the front of closed loop 20. In this position, the user's hands and feet are both free for kicking or swimming strokes while walker 10 safely supports the user above the water.

Due to the relatively large configuration of walker 10, stability is provided whether the water is flat and smooth or whether it is rough with waves. Also, by providing more than sufficient buoyancy, walker 10 enables the user to move about in the water independent of any other person, yet if desired, another person or persons can also grasp and rest upon walker 10 in deeper water. Also, as can be seen, walker 10 provides either continuous support to the user (such as when in the floating position) or such support is supplied only intermittently as needed (such as when the person falters while walking or wading - FIG. 6). Also, while walker 10 is ideal for use by a handicapped or physically impaired person, it can also be successfully used by any person whose mobility has been compromised for any reason, including age or illness. Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A flotation device for supporting a person upon a body of water comprising:

(a) outer buoyancy members interconnected to form a continuous outer enclosure for surrounding said person;

(b) a plurality of elongated braces each having one end secured to one of said outer buoyancy members and extending inwardly therefrom;

(c) a seat assembly secured to the opposite ends of said elongated braces and thereby surrounded by said outer enclosure, said seat assembly comprising a continuous inner enclosure with a seat secured thereto; and, (d) rigid hand rest means spaced from said inner enclosure of said seat assembly and secured to at least one of said outer buoyancy members and extending inwardly thereof and generally planar with said inner enclosure.

2. The floatation device as set forth in claim 1 wherein said outer buoyancy members are surrounded by soft padding.

3. The floatation device as set forth in claim 2, wherein said outer buoyancy members comprise hollow piping or tubing.

4. The floatation device as set forth in claim 2, wherein said outer buoyancy members comprise foam covered supports.

5. The floatation device as set forth in claim 2, wherein said outer buoyancy members form a generally square or rectangular shape.

6. The floatation device as set forth in claim 2, wherein said elongated braces have a cross-sectional area less than that of said outer buoyancy members.

7. The floatation device as set forth in claim 6, further comprising one or more of said braces depending from opposing sides of said enclosure and one or more of said braces securing the rear side thereof to said outer buoyancy members.

8. The floatation device as set forth in claim 7 wherein said seat comprises a flexible fabric suspended from said enclosure.

9. A flotation device for supporting a person upon a body of water comprising:

(a) interconnected outer support members surrounded by soft padding which provide buoyancy to said device, said support members comprising hollow piping or tubing and forming a continuous outer buoyant or first enclosure around said person, said outer support members forming a generally square or rectangular shape;

(b) at least one elongated brace extending inwardly from one set of the opposing sides of said continuous enclosure;

(c) at least one elongated brace extending inwardly from a region of said first continuous enclosure intermediate said opposing sides of said continuous enclosure, said elongated braces have a cross-sectional area less than that of said outer support members;

(d) a centrally located seat assembly within said first outer continuous enclosure, said seat assembly comprising a flexible fabric seat suspended from said inner enclosure and being secured to said braces and forming a continuous second or inner enclosure around the person; and, (e) a rigid hand rest secured to one of said buoyancy members and spaced from said inner enclosure of said seat assembly and secured to at least one of said outer support members and generally planar with said inner enclosure.

10. A flotation device for supporting a person upon a body of water comprising:

(a) interconnected outer support members which provide buoyancy to said device, said support members forming a continuous outer buoyant or first enclosure around said person;

(b) elongated brace means extending inwardly from one set of the opposing sides of said continuous enclosure;

(c) said brace means extending inwardly from a region of said first continuous enclosure intermediate said opposing sides of said first continuous enclosure;

(d) a centrally located seat assembly concentrically positioned within said first or outer continuous enclosure, said seat assembly being secured to said brace means and forming a second or inner enclosure around the person; and, (e) a rigid hand rest secured to the inner portion of one of said outer support members and generally planar with said inner enclosure.

* * * * *